US005080241A

United States Patent [19]

Konstant

[11] Patent Number: 5,080,241

[45] Date of Patent: Jan. 14, 1992

[54] ROLLING RACK FOR SKIDS AND THE LIKE

[76] Inventor: Anthony N. Konstant, 920 Fisher La., Winnetka, Ill. 60093

[21] Appl. No.: 652,644

[22] Filed: Feb. 8, 1991

[51] Int. Cl.[5] ..... A47F 5/00

[52] U.S. Cl. ..... 211/151; 211/59.2; 414/276

[58] Field of Search ..... 211/151, 59.2; 414/276, 414/286

[56] References Cited

U.S. PATENT DOCUMENTS

| | | | |
|---|---|---|---|
| 4,341,313 | 7/1982 | Doring | 414/276 X |
| 4,462,500 | 7/1984 | Konstant et al. . | |
| 4,613,270 | 9/1986 | Konstant et al. . | |
| 4,687,404 | 8/1987 | Seiz et al. | 211/151 X |
| 4,773,546 | 9/1988 | Konstant | 211/151 |
| 4,915,240 | 4/1990 | Konstant . | |
| 4,955,489 | 9/1990 | Allen | 414/276 X |

*Primary Examiner*—Robert W. Gibson, Jr.
*Attorney, Agent, or Firm*—George H. Gerstman; Garrettson Ellis

[57] ABSTRACT

A rack having rolling carts that roll together one on top of the other. The second cart may define front and rear wheels that roll on outwardly facing tracks of the rails, while the first cart defines at least rear wheels that roll on inwardly facing tracks of the rails. Front wheels of the first cart may roll on the outwardly facing tracks, to make room for skid support means carried between a forward portion of the rails.

28 Claims, 2 Drawing Sheets

10
12
14
16
18
20
22
24
26
28
30
32
34
35
36
38
40
42
44
46
50
52
54
56
58
60
2
3

ROLLING RACK FOR SKIDS AND THE LIKE

BACKGROUND OF THE INVENTION

In Konstant U.S. Pat. No. 4,915,240 and elsewhere rolling racks are disclosed in which at least first and second wheeled carts are mounted in rolling relation with a pair of rails. The respective carts roll over each over, with one cart being higher to accomplish this, so that the respective cart may all be presented in a vertically stacked array at the front end of the rack. Then, as pallets of the like are to be stored, they are placed one by one on each rolling rack, which is then rolled rearwardly by the emplacement of another pallet on the rack below a rolling rack that carries a pallet. Finally, the last pallet can be placed on the front end of the rails.

Other patents that teach various designs of rolling racks include Döring U.S. Pat. No. 4,341,343 and Konstant et al. U.S. Pat. Nos. 4,462,500 and 4,613,270, as well as Seiz et al. U.S. Pat. No. 4,687,404.

In the previously cited Konstant U.S. Pat. No. 4,915,240 pairs of overlapping carts are disclosed which roll on the same track surfaces. To provide substantial free rolling of individual carts over a limited distance, the front wheels of the upper cart are positioned between the front and rear wheels of the lower cart, so that the upper cart can roll rearwardly, carrying a pallet or the like without causing motion of the lower cart, until the front wheels of the upper cart collide with the rear wheels of the lower cart. Thus, if the lower cart is long enough, the upper cart can be pushed backward far enough to permit a pallet to be placed on the lower cart after a pallet has been placed on the upper cart.

While the above system works well, it does require that at least the lower carts must be of extended length, over and above what they would normally have to be to receive a pallet.

In accordance with this invention, a rolling pallet system is provided in which the respective carts do not have to be of extra length, while the same rail surfaces may be used by both carts. In this invention, the upper cart can be moved rearwardly as far as desired without engaging any wheels of a lower cart, which provides an added advantage to this invention.

It is also preferred for the carts of this invention to be modified to receive a slipsheet, skid or the like. A "skid" is a support structure for merchandise or other articles which has only two stringers and a top board, typically without middle support. The two stringers are positioned on opposed edges of the top board. Alternatively, there are other kinds of skids which may have multiple legs, extending downwardly from a board, which legs are made of coiled cardboard or the like. A nine legged skid is typically used. By this invention racks for use with slipsheets and skids of both types may be provided.

DESCRIPTION OF THE INVENTION

In this invention, a pallet rack is provided which comprises at least one pair of spaced, parallel rails having inwardly and outwardly facing rolling rail surfaces. First and second wheeled carts are mounted in rolling relation with said rails, the second cart being capable of rolling over the first cart to overlie the first cart.

By this invention, the second cart may define front and rear wheels that roll on outwardly facing tracks of the rails. The first cart defines front wheels that roll on the outwardly facing tracks, and rear wheels that roll on inwardly facing tracks of the rails.

By one advantage of this invention, one of the sets of tracks, typically the inwardly facing set, may terminate short of the other, either or both at the front or the rear, to provide a savings of fabricating material in the rack of this invention. Also, the inwardly facing tracks may be defined by a second pair of rails which are space inwardly from the pair of rails that define the outwardly facing tracks. When this is the case, transverse skid support members may be positioned between the adjacent rails of the one pair and the second pair. Such support members serve to support skids of different widths, with the skid resting on its lateral stringers, so that such skids are placed on the rack of this invention with substantial ease without the need to balance the stringers on the rails.

If desired, at least one of the carts may define a central aperture defined between inner longitudinal support members. Such a cart may also define outer longitudinal support members, carried between the inner and outer longitudinal support members. Thus, the side stringers of skids may rest on the transverse support members.

Preferably, the first and second carts each have a front edge, with the front wheels of the second cart being spaced away from the front edge of the second cart by a distance which is greater than the spacing of the first cart front wheels from the first cart front edge. Thus, when the first and second carts are in overlapping relation, their respective front edges may be in closely aligned relation, that is to say in their forwardmost rolling position.

Another embodiment of the cart of this invention, as before, comprises at least one pair of spaced, parallel rails having inwardly and outwardly facing rolling rails facing first surfaces and first and second wheeled carts mounted in rolling relation with the rails. As before, the second cart is capable of rolling over the first cart to overlie it. However, a pair of outer rails and a pair of inner rails are defined in which the inner rails are spaced from the outer rails and parallel thereto. Transverse skid support members are carried between the adjacent outer and inner rails, with the first cart carrying wheels that roll on the inner rails and the second cart carrying wheels that roll on the outer rails.

Preferably, the inner rails define an inwardly facing track while the outer rails define an outwardly facing track, for the wheels of said carts.

Also, it is preferred for the transverse skid support members to be essentially all carried between those halves of the outer and inner rails which are closest to the front end of the rack. In other words, the front portion of the rails carry the transverse skid support members, while the rear portions of the rails carry essentially none of the skid support members.

In this embodiment, the outer rails may extend rearwardly beyond the inner rails, to permit the upper of the carts to roll completely to the rear while saving construction materials, since the lower cart does not normally roll to the rear anyway, and thus does not require the capability to do so.

DESCRIPTION OF SPECIFIC EMBODIMENTS

Figures 1, 2, 3:
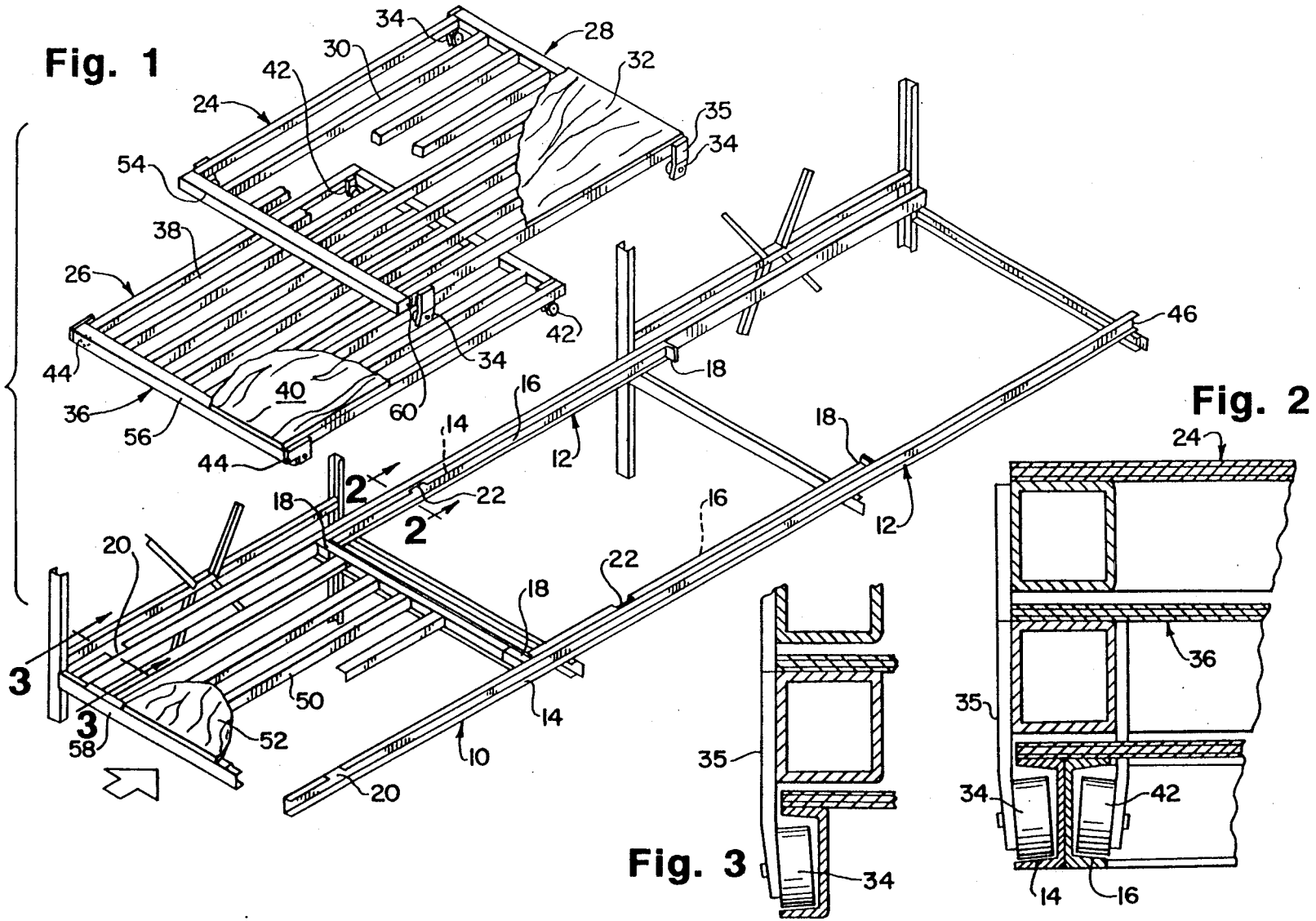
FIG. 1 is an exploded, perspective view of one embodiment of the rolling cart rack of this invention.
FIG. 2 is a sectional view taken along line 2—2 of FIG. 1.
FIG. 3 is a sectional view taken along line 3—3 of FIG. 1.

Referring to FIGS. 1 through 3, a first embodiment of a rolling cart rack system 10 is shown. System 10 comprises a pair of rails 12, each of which rails comprises a pair of outwardly facing rail surfaces 14 and inwardly facing rail surfaces 16. Inwardly facing rail surfaces 16 can be seen to be shorter than outwardly facing rail surfaces 14, occupying only approximately a third to one-half of the overall length of rail surfaces 14 and with the ends of inner rail surfaces 16 terminating at locations 18, which locations are spaced from the ends of outwardly facing rail surfaces 14. The respective rail surfaces 14, 16 may each be defined by C-channel iron, with the two rail surfaces 14, 16 being held together in back-to-back relation as shown in FIG. 2.

Slots 20, 22 serve as access ports for the wheels of the respective carts that roll on rack 10.

In this embodiment, a pair of carts 24, 26 are provided. Cart 24 comprises a cart body 28 having support bars 30, which may be overlaid by or replaced by an optional sheet of plywood 32. Cart 24 carries wheels 34 at each corner, each of which wheels face inwardly from a wheel bracket to roll on the respective outwardly facing rail surfaces 14 of rack 10. Thus, cart 24 can roll the entire length of rack 10 along the relatively elongated rail surfaces 14.

Brackets 35 are of a height to hold cart body 28 sufficiently high above wheels 34 so that cart 24 can ride over cart 26.

Cart 26, in turn, defines a cart body 36 that may be similar in construction to the structure of cart body 28 of cart 24. In a similar manner, cart body 36 may carry support struts 38 which may be replaced by or overlaid by optional plywood deck 40, as desired. Cart 36 defines wheels at each corner in a manner similar to cart 24, except that rear wheels 42 of cart 36 face outwardly to roll in the inwardly facing rail surfaces 16. On the other hand, forward wheels 44 face inwardly from their brackets, to roll along with wheels 34 on outwardly facing rolling surfaces 14.

Because of this interrelation between the wheels of the carts and the inwardly and outwardly facing rolling surfaces, it is possible for more advantages to be achieved. First, upper cart 24 can roll to the rear end 46 of rack 10 without interference from the rear wheels 42 of lower cart 26, since rear wheels 42 do not roll on rolling surfaces 14 but rather on inwardly facing rolling surfaces 16. Lower cart 26, on the other hand, can roll rearwardly to a point approximately central of the overall length of the rack, particularly to clear the forward third of the rack for a skid or the like which rests upon the frame structure of the rack itself. Thus, three skids can be easily stored in the system of FIG. 1. A first skid rests upon upper cart 24, which cart is then pushed rearwardly when a second skid is emplaced upon lower cart 26. Then, lower cart 26 is pushed rearwardly and a third skid rests upon the structural bars 50 which are placed between rails 12 in the approximate front third of the rack system, being optionally overlaid by plywood decking 52, or replaced thereby, as may be preferred.

Despite the presence of support bars 50 and plywood decking 52, it is still possible for both carts 24, 26 to roll forwardly to the full forward position at which their front cross-bars 54, 56 overlie the front crossbar 58 of the rack itself. Thus a unique combination of advantages is achieved by the rack of this invention in that the upper cart can move fully to the rear, but at the same time the approximate front third of the rack structure may have supporting bars and/or decking in a manner similar to the rolling carts, so that skids may be placed on the front of the rack as well as the rolling carts. Optionally, a flexible plastic or cardboard slipsheet may be positioned under a load, being held in position by supporting bars 50 or decking 52, or on either cart 24, 26. However, despite the presence of the supporting bars and/or decking, it still is possible for the carts 24, 26 to be brought to a full forward position in order to receive a skid, slipsheet, or the like from a lift truck.

Rails 12 may be conventionally supported by any desired beam and column system, typically with pairs of rails being placed one above the other to provide a stacked rack in accordance with this invention, for a warehouse.

Specifically, so that front bars 54 and 56 of the two carts may overlie each other in their forward position, the front wheels 34 of upper cart 24 are spaced away from front edge 54 by a distance 60 which is greater than the spacing of front wheels 44 of lower cart 26 from its front beam 56, as shown in FIG. 1. Thus, when wheels 34 impact against wheels 44 as the two carts come to their maximum forward position, front bars 54, 56 of the two carts may directly overlie each other, this being controlled by the precise positioning of the respective wheels 34, 44 along the carts.

Figure 4:
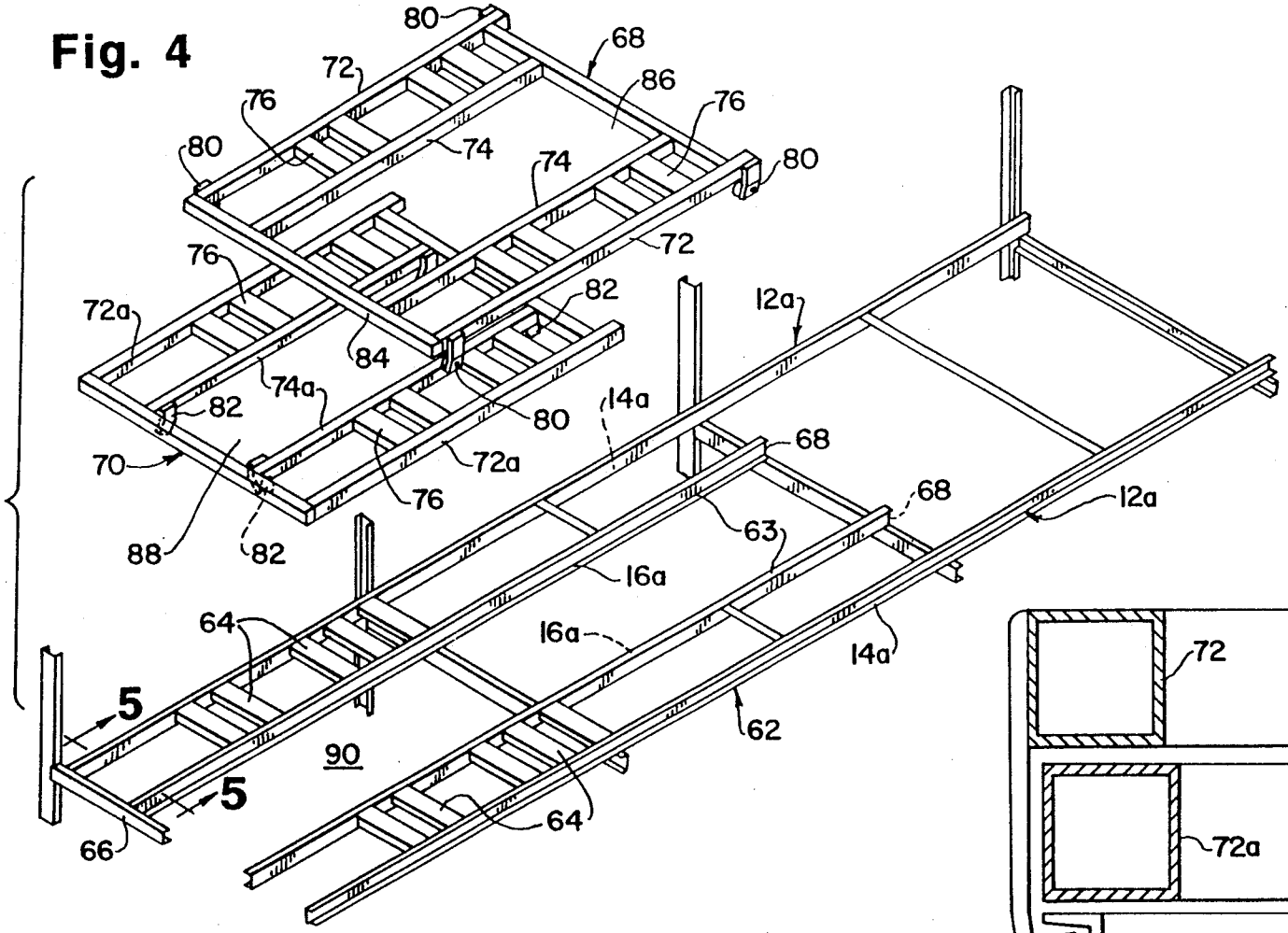
FIG. 4 is an exploded perspective view of another embodiment of the rolling cart rack of this invention.
Figure 5:
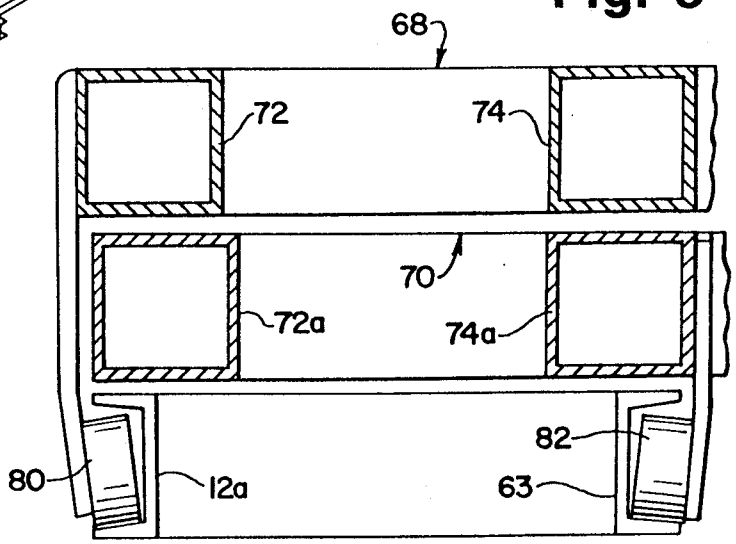
FIG. 5 is a sectional view taken along line 5—5 of FIG. 4.

Referring now to FIGS. 4 and 5, another embodiment of rolling cart rack 62 is disclosed, being generally similar to the previous embodiment, except as otherwise indicated herein.

As before, rack 62 defines a pair of spaced, parallel rails 12*a* which define outwardly facing rail surfaces 14*a* in a manner similar to the previous embodiment. However, in this embodiment, rails 63 having inwardly facing rail surfaces 16*a* are defined by channel iron members which are spaced inwardly from outer rails 12*a* by a substantial space, contrary to the previous embodiment where the respective channel iron members defining the inwardly and outwardly facing rail surfaces were in essentially abutting relation with each other. Also, transverse skid support members 64 are carried between adjacent inner and outer rails 12*a*, 63. The transverse skid support members 64 are positioned typically in the forward third of rails 12*a*, 63, between the respective rails 12*a*, 63 to facilitate the support of a skid by its side stringers resting on transverse skid support members 64.

It can be seen that inner rails 63 extend about from the front end 66 of rack 62 rearwardly for about two-thirds of the distance of rails 12*a*, to permit the cart which rolls on rails 63 to move rearwardly for about two-thirds of the distance of rails 12*a*. Stop members 68 are positioned to prevent the wheels of the carts from rolling out of rails 63, 12*a*.

The respective rolling carts 68, 70 which ride on the rack 12*a* each define an outer frame having side beams 72, 72*a*, plus a pair of inner beams 74, 74*a* which are parallel to outer side beams 72, 72*a*. Between each of the pairs of respective beams 72, 74, 72*a*, 74*a* there is positioned a series of transversely extending skid support members 76, so that the side stringers of skids may be easily placed in the area defined about skid support members 76. Particularly, skids of differing widths may be applied to the same individual carts by the design provided herein, as well as to support members 64.

Upper cart 68 defines inwardly facing wheels 80 at substantially its respective corners.

Lower cart 70, however, defines wheels 82 not at the outer corners of cart 70, but rather, wheels 82 are placed inwardly of the side edges of cart 70 and typically adjacent the ends thereof on beams 74*a*, with wheels 82 facing outwardly to engage inwardly facing rail surfaces 16*a* to roll thereon. The wheels of cart 68 engage outwardly facing rail surfaces 14*a* for rolling.

Thus upper cart 68 can roll the entire length of the rack along rail 12*a*, while lower cart 70 is capable only of rolling approximately two-thirds of the length of the entire rack along rails 73.

In a manner similar to previous embodiment designs, rack 62 is slightly sloped so that carts 68, 70 are urged forwardly toward front end 66, where they may be stopped by conventional means. A first skid is loaded on rolling cart 68, following which a second skid may be applied to rolling cart 70 by pushing the two skids together so that cart 68 rolls rearwardly until the second skid can be deposited upon cart 70. Then, a third skid may be applied by pushing against the second skid to roll both carts further rearwardly and depositing the third skid with its side stringers resting on lateral skid supports 64.

The skid supports 64, 76 may be applied in an irregular pattern as shown, or in a regular pattern, if that is desired.

Each of the carts and the front portion of the rails defines a central aperture 86, 88, 90, which permits bottom access to the skids, and which reduces the need for construction material for manufacture of the rack of this invention.

The above has been offered for illustrative purposes only, and is not intended to limit the scope of the invention of this application, which is as defined in the claims below.

That which is claimed is:

1. In a rack which comprises at least one pair of spaced, parallel rails having inwardly and outwardly facing rolling rail surfaces and first and second wheeled carts mounted in rolling relation with said rails, said second cart being capable of rolling over said first cart to overlie said first cart, the improvement comprising, in combination:

said second cart defining front and rear wheels that roll on outwardly facing tracks of said rails, said first cart defining front wheels of the first cart that roll on said outwardly facing tracks and rear wheels that roll on inwardly facing tracks of said rails.

2. The rack of claim 1 in which said inwardly facing tracks terminate short of said outwardly facing tracks.

3. The rack of claim 1 in which said inwardly facing tracks are positioned between said outwardly facing tracks.

4. The rack of claim 1 in which said inwardly facing tracks are defined by a second pair of rails which are spaced inwardly from said pair of rails that define said outwardly facing tracks.

5. The rack of claim 4 in which transverse support members are positioned between the adjacent rails of said one pair and second pair.

6. The rack of claim 1 in which at least one of said carts defines a central aperture defined between inner, longitudinal support members.

7. The rack of claim 6 in which said one cart also defines outer, longitudinal support members, and transverse support members carried between said inner and outer, longitudinal support members, whereby the side stringers of skids may rest on said transverse support members.

8. The rack of claim 1 in which said first and second carts each have a front edge, the front wheels of the second cart being spaced away from the second cart front edge by a distance greater than the spacing of the first cart front wheels from the first cart front edge, to cause the front edges of said carts to be in closely overlying relation in their forwardmost rolling position.

9. The rack of claim 1 in which said inwardly facing tracks terminate short of both ends of said outwardly facing tracks.

10. The rack of claim 1 in which at least one of said first and second carts each define an outer wheel-carrying frame and inner horizontal beams for support of a load.

11. The rack of claim 1 in which at least one of said first and second carts defines an outer wheel-carrying frame and a solid deck carried by said frame.

12. In a rack which comprises at least one pair of spaced, parallel rails having inwardly and outwardly facing rolling rail surfaces and first and second wheeled carts mounted in rolling relation with said rails, said second cart being capable of rolling over said first cart to overlie said first cart, the improvement comprising, in combination:

said rack defining a pair of outer rails which define an outwardly facing track and a pair of inner rails which define an inwardly facing track and which are spaced from said outer rails and parallel thereto, and transverse support members carried between adjacent outer and inner rails, said first cart carrying wheels that roll on the inner rails and the second cart carrying wheels that roll on the outer rails.

13. The rack of claim 12 in which the transverse support members are essentially all carried between the halves of the outer and inner rails closest to the front end of the rack.

14. The rack of claim 12 in which said outer rails extend rearwardly beyond said inner rails.

15. In a rack which comprises at least one pair of spaced, parallel rails having inwardly and outwardly facing rolling rail surfaces, and first and second wheeled carts mounted in rolling relation with said rails, said second cart being capable of rolling over said first cart to overlie said first cart, the improvement comprising, in combination:

said inwardly and outwardly facing rolling rail surfaces extending through a central portion of the length of said rails, one of said rolling rail surfaces terminating short of the other of said rolling rail surfaces.

16. The rack of claim 15 in which said inwardly facing rolling rail surfaces extend forwardly with said outwardly facing rolling rail surfaces to the front of said rack, but terminate short of the rear of said rack.

17. The rack of claim 15 in which said inwardly facing rolling rail surfaces terminate short of both the front end of said rack and the rear end of said rack.

18. In a rack which comprises at least one pair of spaced, parallel rails having inwardly and outwardly facing rolling rail surfaces, and first and second wheeled carts mounted in rolling relation with said rails, said second cart being capable of rolling over said first cart to overlie said first cart, the improvement comprising, in combination:

said second cart defining front and rear wheels that roll on outwardly facing tracks of said rails, said first cart defining front wheels that roll on said outwardly facing tracks and rear wheels that roll on inwardly facing tracks of said rails, and support means for a load carried between said rails at a forward portion thereof.

19. The rack of claim 18 in which said inwardly facing rail surfaces terminate short of said outwardly facing rail surfaces.

20. The rack of claim 19 in which said first and second carts each have a front edge, the front wheels of the second cart being spaced away from the second cart front edge by a distance greater than the spacing of the first cart front wheels from the first cart front edge, to cause the front edges of said carts to be in closely overlying relation in their forwardmost rolling position.

21. The rack of claim 18 in which said inwardly facing rail surfaces terminate short of both ends of said outwardly facing rail surface.

22. The rack of claim 18 in which said support means for a load carried between said rails at a forward portion thereof comprises horizontal support beam means.

23. The rack of claim 22 in which said horizontal support beam means are positioned essentially parallel to said rails.

24. The rack of claim 18 in which said support means for a load carried between said rails at a forward portion thereof comprises a solid deck.

25. The rack of claim 18 in which at least one of said first and second carts each define an outer wheel-carrying frame and inner horizontal beams for support of a load.

26. The rack of claim 18 in which at least one of said first and second carts defines an outer wheel-carrying frame and a solid deck carried by said frame.

27. In a rack which comprises at least one pair of spaced, parallel rails having inwardly and outwardly facing rolling rail surfaces and first and second wheeled carts mounted in rolling relation with said rails, said second cart being capable of rolling over said first cart to overlie said first cart, the improvement comprising, in combination:

said rack defining a pair of outer rails and a pair of inner rails spaced from said outer rails and parallel thereto, and transverse support members carried between adjacent outer and inner rails, said first cart carrying wheels that roll on the inner rails and the second cart carrying wheels that roll on the outer rails, said inner rails defining an inwardly facing track and the outer rails defining an outwardly facing track for the wheels of said carts, said outer rails extending rearwardly beyond said inner rails.

28. The rack of claim 27 in which the transverse support members are essentially all carried between those halves of the outer and inner rails which ar closest to the front end of the rack.

* * * * *